United States Patent [19]

Hodson

[11] Patent Number: 4,552,463

[45] Date of Patent: Nov. 12, 1985

[54] METHOD AND APPARATUS FOR PRODUCING A COLLOIDAL MIXTURE

[76] Inventor: Harry Hodson, 4730 Dunn Dr., Sarasota, Fla. 33583

[21] Appl. No.: 589,714

[22] Filed: Mar. 15, 1984

[51] Int. Cl.[4] ..... B01F 7/20

[52] U.S. Cl. ..... 366/295; 366/307; 366/329

[58] Field of Search ..... 366/65, 136, 137, 241, 366/279, 302, 303, 304, 306307, 325, 327, 329, 292, 295

[56] References Cited

U.S. PATENT DOCUMENTS

| | | | |
|---|---|---|---|
| 271,242 | 1/1883 | Hobbs | 366/307 |
| 296,159 | 4/1884 | Gill | 366/302 |
| 2,074,673 | 3/1937 | Sackett | 366/137 |
| 2,146,566 | 2/1939 | Daman | 366/137 |
| 2,840,355 | 6/1958 | Stratford | 366/302 |
| 4,457,627 | 7/1984 | Kirby et al. | 366/65 |
| 4,480,926 | 11/1984 | Lattery, Jr. et al. | 366/327 |

FOREIGN PATENT DOCUMENTS

| | | | |
|---|---|---|---|
| 1145355 | 10/1957 | France | 366/327 |

*Primary Examiner*—Robert W. Jenkins
*Assistant Examiner*—Arthur D. Dahlberg
*Attorney, Agent, or Firm*—A. W. Fisher, III

[57] ABSTRACT

A method and apparatus for producing a colloidal mixture of a high degree of hydration comprising a hollow enclosure having a feed inlet to receive at least two dissimilar products to be colloidalized and a discharge outlet to dispense the colloidal mixture comprising a thrust generating assembly including a down thrust generating component and an upthrust generating component to cooperatively generate a pair of concentrically disposed cylinders of liquid mass moving in opposite directions relative to each other within the hollow enclosure such that the interface face between moving liquid masses forms a liquid shear zone to impart high energy mixing therebetween to produce the colloidal mixture.

7 Claims, 7 Drawing Figures

FIG. 1
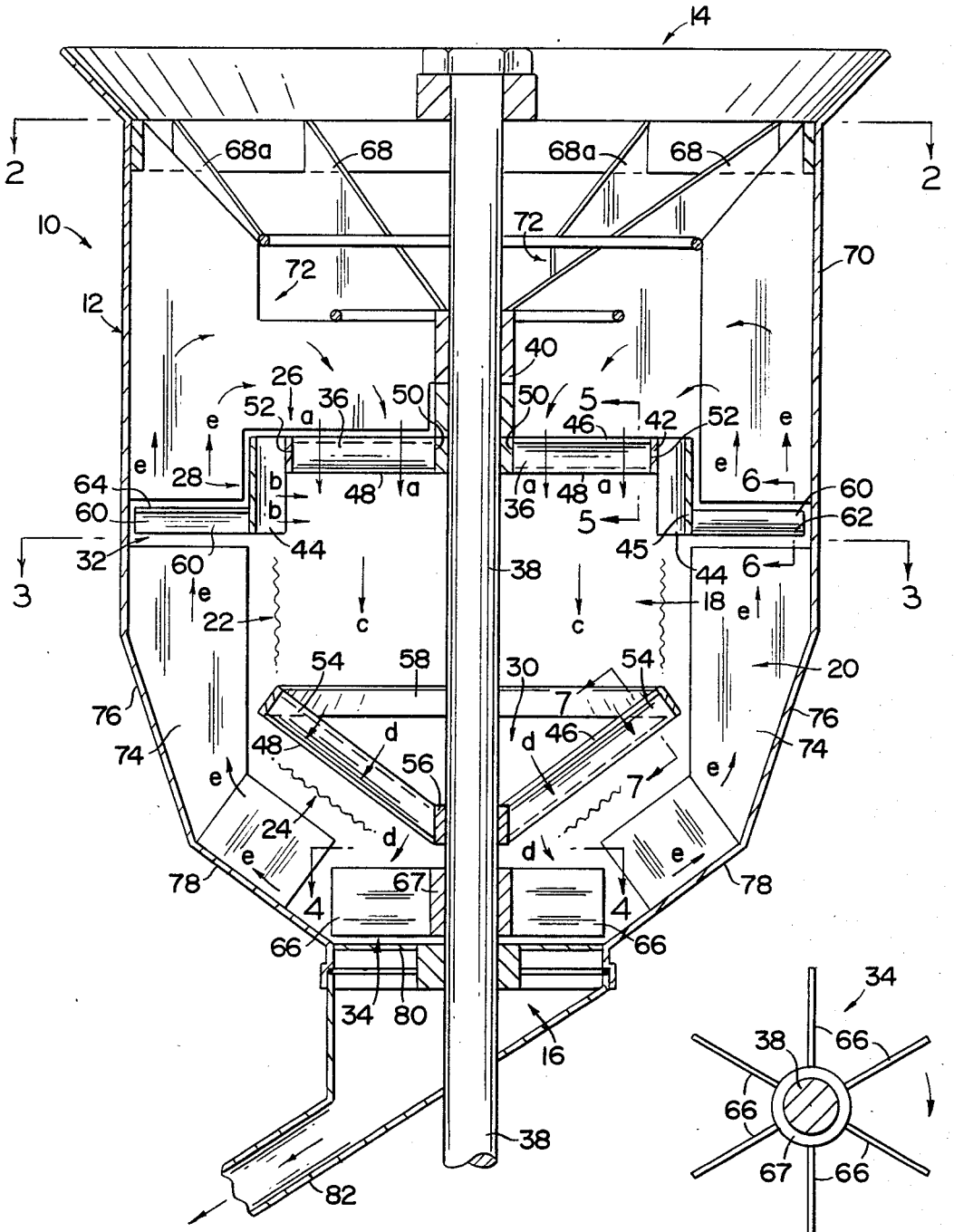
FIG. 4
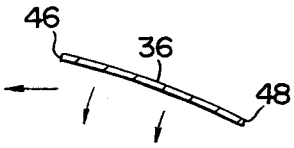
FIG. 5
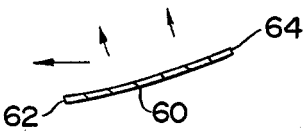
FIG. 6
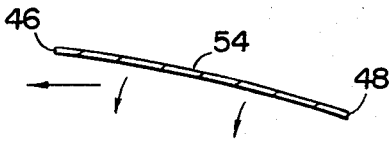
FIG. 7

FIG. 2
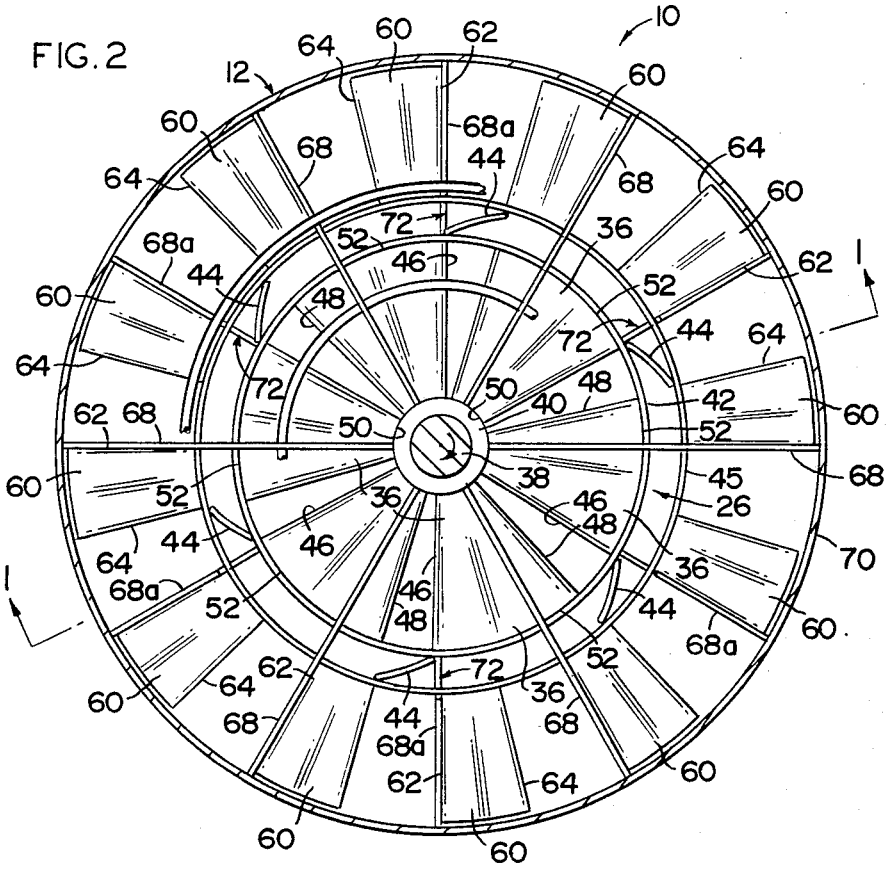
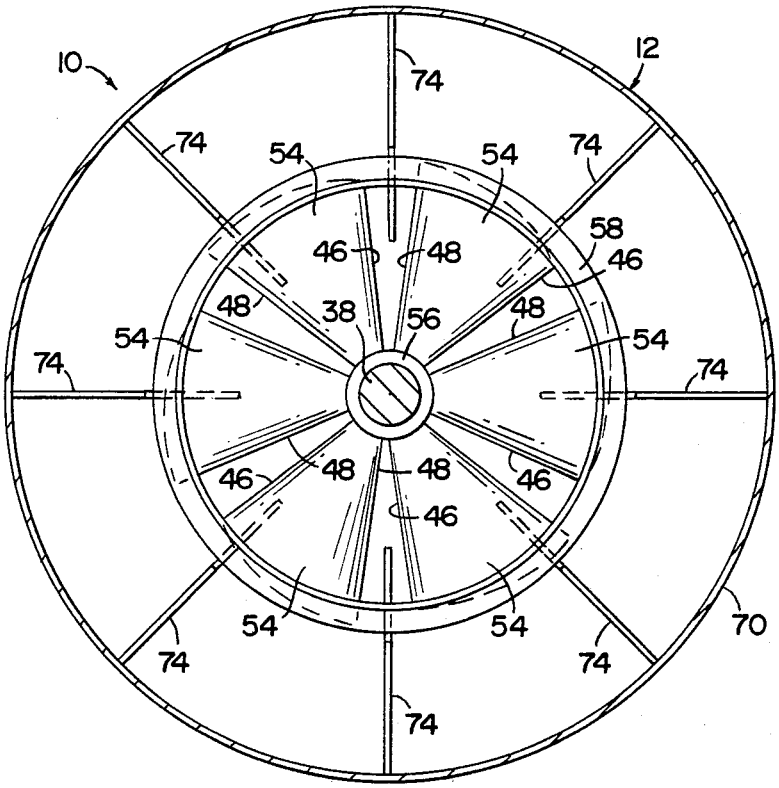
FIG. 3

METHOD AND APPARATUS FOR PRODUCING A COLLOIDAL MIXTURE

BACKGROUND OF THE INVENTION

1. Field of the Invention

A method and apparatus to produce a colloidal mixture.

2. Description of the Prior Art

As is well recognized in the construction and building industry concrete is used generically to define a collection or aggregation of materials which together form a reasonably continuous and consistent solid when cured. In conventional applications of concrete products, voids and/or small discontinuities or inclusions of air within the resulting product are considered to be highly undesirable. This is true since such voids normally affect the operating or performance characteristics of the product in a harmful manner.

The following U.S. Pat. Nos. disclose prior art products or cementitious material which is generally applicable but clearly distinguishable from the product which is formed through the utilization of the method and apparatus of the present invention: 2,710,802 to Lynch, 3,583,88 to Moore, 1,665,104 to Martienssen, 3,196,122 to Evans, 3,240,736 to Beckwith, 3,360,493 to Evans, 3,429,450 to Richards, 3,477,979 to Hillyer, 3,687,021 to Hinsley, 3,690,227 to Weltry, 3,870,422 to Medico, 2,130,498 to Klemschofski, 3,822,229 to McMasters, 954,511 to Gordon, 2,851,257 to Morgan, 3,877,881 to Ono, 4,225,247 and 4,225,357 to Hodson.

The products of the type generally disclosed in the above set forth U.S. patents frequently suffer from certain inherent disadvantages. Such disadvantages include failure under heavy load, stress conditions and excessive cost as in highway construction. However, there is an acknowledged need in the construction industry, especially in the area of building roads, highways and bridges for a concrete type product at a reasonable cost and able to stand high load or stress conditions for high speed operation of large or heavy motor vehicles.

Both in pervious and non-pervious concrete, a high shear mixer may be used to produce a cement-water component of high strength and increased viscosity resulting in a high strength structure. However, the process of combining or mixing cement and water can be carried much further, although not necessarily of benefit in pervious concrete, since a greater intensity of fine particle mixing produces a cement-water combination of paint-like consistency, which sets to a gloss-like surface, not appropriate to pavement.

With proper techniques, such a super-mixed mortar can be directly sprayed, painted or otherwise applied to cement products, and with proper curing processes produces a surface which is more durable than normal concrete, and which has an appearance similar to glazed ceramic tile. By the use of white cement, in place of grey, and standard organic mineral colors, many decorative effects can be obtained. Experience has shown that the surface produced is extremely durable, although its Mohr hardness value is below the level of kiln-fired ceramics. For example, it can be scratched by martensitic steel if a blade or tool is applied with sufficient pressure, or by abrasion with silicone compounds.

In explanation of this result, it appears that, in general, high energy mixing further colloidalizes the cement: water fraction, and produces a new mortar form proportional to the intensity of mixing which results in combination and hydration superior to that accomplished by present mixing methods. It should be noted that the limitation of particle fineness in cement clinker grinding during production, as presently practiced, is to prevent shrinkage, surface crazing, cracking and flash setting thought to be an uncontrolled hydration effect.

However, the colloidalized mortar shows no signs of such defects. Apparently, the colloidalizing process accelerates hydration exothermic behaviour so as not to protract heat loss and shrinkage factors in the setting phase. At the same time it appears to produce more of the strength intrinsically available from the hydration of cement as indicated by the known ability to re-grind set concrete, which may then be mixed with water, when it will again generate some setting strength illustrating its full potential is not reached in normal concrete practice.

Assuming a strength increase as high as may be expected from recognized re-grinding and remixing data, it should be possible to considerably reduce the cement content of concretes and still obtain comparable strengths. In addition, this idea can be extended to the use of pozzolanic additives, particularly fly ash, which is a by-product of coal-fired furnaces. This will further reduce the cement consumption. It may ultimately be possible to use a lime and fly ash to completely replace cement, without the use of partial fusion, as now practiced in cement production.

It is readily believed that the inherent deficiencies set forth above are due to a failure to fully form the hydrated product when utilizing conventional or currently known techniques as in the formation of substantially conventional concrete utilizing conventional cement, water and aggregate components in a manner which will result in more favorable operating and performance characteristics.

SUMMARY OF THE INVENTION

The present invention relates to a method and apparatus for producing a colloidal mixture with a high degree of hydration comprising a hollow enclosure having a feed inlet to receive at least two dissimilar products to be colloidalized and a discharge outlet to discharge the colloidal mixture.

The apparatus comprises a thrust generating assembly or means including a down thrust generating component and an up thrust generating component to cooperatively form a pair of substantially cylinders of liquid masses moving in opposite directions relative to each other within the hollow enclosure such that the interface between the moving liquid masses forms liquid shear zone including an upper shear zone and lower shear zone to impart high energy mixing therebetween to produce the colloidal mixture.

The down thrust generating component comprises a first and second upper set of down thrust blades and a lower set of down thrust blades. The up thrust generating component comprises an upper and lower set of up thrust blades.

The first upper set of down thrust blades comprises a plurality of substantially horizontal first upper down thrust blades in spaced relation relative to each other coupled to a drive shaft. The second upper set of down thrust blades comprises a plurality of substantially vertical second upper down thrust blades, in spaced relation relative to each other. Each of the first upper set of blades is substantially pie-shaped in configuration having a leading and trailing edge.

The leading edge is disposed upwardly of the trailing edge in the vertical plane both at the origin and terminus of each first upper set blade by a substantially equal distance. Thus, the overall configuration of each forms a partial horizontal first upper down thrust blades forms a partial helical spiral. The inner portion of each lower down thrust blade is attached to the drive shaft such that the plurality of blades are substantially conical or angular disposition relative to the drive shaft and first upper set of down thrust blades and extend in a substantially horizontal disposition. The upper up thrust blades are substantially the same configuration as the first upper down thrust blades except having the leading edge lower than the trailing edge. The lower set of up thrust blades comprises a plurality of flat substantially rectangular lower up thrust blades vertically disposed and coupled to the drive shaft.

To increase the vertical components of the liquid mass movement, an upper and lower directional control means is provided. The upper directional control means comprises a plurality of vertically disposed upper baffles extending inwardly from the upper portion of the hollow enclosure or container. Alternating upper baffles include a cut-out portion on the inner end thereof while the other upper baffles extend to the center of shaft. The lower directional control means comprises a plurality of vertically disposed lower baffles on the lower portion of the container.

The container comprises a substantially cylindrical upper portion having an intermediate portion including a first and second inclined surface, where the second inclined surface is substantially parallel to the lower down thrust blades and a lower substantially horizontal bottom. Disposed in communication with the discharge outlet is a discharge chute for selectively dispensing the colloidal mixture.

In operation, two dissimilar products are fed to the hollow enclosure through the feed inlet. With the drive shaft rotating through a conventional drive mechanism, the up thrust and down thrust generating components generate an upward and downward thrust as more fully described hereinafter. The drive shaft may be supported within the hollow enclosure by a spider frame or other suitable support means. Specifically, as the two dissimilar products are directed toward the center of the apparatus by baffles the products are thrust downward under the mechanical force of the first upper down thrust blades. The second upper down thrust blades redirect the horizontal or rotational movement of the liquid mass to the downward direction. As the liquid mass travels downwardly with a substantial vertical component and a lesser horizontal component, the liquid mass enters the lower down thrust blades forcing the liquid mass downwardly and outwardly. The liquid mass is then redirected upwardly generating a substantially vertical component under the influence of the lower baffles.

The lower up thrust blades force the liquid mass to move outwardly and upwardly. As the liquid mass moves upwardly the mechanical force of the upper up thrust blades continues to force or propel the liquid mass upwardly. The baffles reduce the centrifugal or horizontal component and direct the liquid mass to enter into the mechanical influence of the first upper down thrust blades. This is continued until the desired colloidal mixture is produced.

As previously indicated alternating upper baffles are reduced to permit proper and sufficient flow of the dissimilar products from the up thrust liquid mass to its reintroduction to the down thrust liquid mass under the influence of the first upper down thrust blades.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a cross-sectional side view of the apparatus for producing a colloidal mixture.

FIG. 2 is a cross-sectional top view of the apparatus taken along line 2—2 of FIG. 1.

FIG. 3 is a cross-sectional top view of the apparatus taken along line 3—3 of FIG. 1.

FIG. 4 is a cross-sectional top view of the apparatus taken along line 4—4 of FIG. 1.

FIG. 5 is a partial cross-sectional end view of a first upper down thrust blade taken along line 5—5 of FIG. 1.

FIG. 6 is a partial cross-sectional end view of an upper up thrust blade taken along line 6—6 of FIG. 1.

FIG. 7 is a partial cross-sectional end view of a lower down thrust blade taken along line 7—7 of FIG. 1.

Similar reference characters refer to similar parts throughout the several views of the drawings.

DETAILED DESCRIPTION OF THE PREFERRED EMBODIMENT

As shown in FIGS. 1, 2, and 3, the subject invention relates to a method and apparatus for producing a colloidal mixture with a high degree of hydration. The apparatus generally indicated as 10 comprises a hollow enclosure generally indicated as 12 having a feed inlet 14 to receive at least two dissimilar products to be colloidalized and a discharge outlet 16 to discharge the colloidal mixture.

As described more fully hereinafter, the apparatus 10 comprises a thrust generating assembly including a down thrust generating component and an up thrust generating component to cooperatively form a pair of substantially concentrical cylinders of liquid masses generally indicated as 18 and 20 respectively, moving in opposite directions relative to each other within the hollow enclosure 12 such that the interface between the moving liquid masses 18 and 20 forms a liquid shear zone including an upper shear zone and a lower shear zone 22 and 24 respectively to impart high energy mixing therebetween to produce the colloidal mixture.

The down thrust generating component comprises a first and second upper set of down thrust blades generally indicated as 26 and 28 respectively and a lower set of down thrust blades generally indicated as 30. The up thrust generating component comprises an upper set of up thrust blades generally indicated as 32 and a lower set of up thrust blades generally indicated as 34.

As best shown in FIGS. 1 and 2, the first upper set of down thrust blades 26 comprises a plurality of substantially horizontal first upper down thrust blades each generally indicated as 36 in spaced relation relative to each other coupled to a drive shaft 38 by a collar 40 having an inner support ring 42 interconnecting the outer portions thereof. The drive shaft 38 is connected to a conventional drive mechanism (not shown). The second upper set of down thrust blades 28 comprises a plurality of substantially vertical second upper down thrust blades each generally indicated as 44 attached between the inner support ring 42 and an outer support ring 45 in spaced relation relative to each other. Each of the first upper down thrust blades 36 is substantially pie-shaped in configuration having a leading and trailing edge 46 and 48 respectively.

As shown in FIG. 5, the leading edge 46 is disposed upwardly of the trailing edge 48 in the vertical plane both at the origin 50 and terminus 52 (FIG. 1) of each first upper down thrust blade 36 by a substantially equal distance such as ½ inch. Thus, the overall configuration of each substantially horizontal first upper set blade is partial helical spiral. As shown in FIG. 1, each of the substantially vertical second upper down thrust blades 44 is arcuate or partially cylindrical. The lower set of down thrust blades 30 comprises a plurality of lower down thrust blades each generally indicated as 54 having a similar configuration as shown in FIG. 7 to that of the substantially horizontal first upper down thrust blades 36. The inner portion of each lower down thrust blade 54 is attached to the shaft 38 by a collar 56 and the upper portion to a support ring 58 such that the plurality of the lower down thrust blades 54 are substantially conical or angular disposed relative to the drive shaft 38 and first upper set of down thrust blades 26. As described more fully hereinafter, the plane of the lower down thrust blades 54 is substantially parallel to a portion of the hollow enclosure 12.

The upper set of up thrust blades 32 comprises a plurality of upper up thrust blades each indicated as 60 coupled to the outer support ring 45 and extend in a substantially horizontal disposition. As shown in FIG. 6, the upper up thrust blades 60 are substantially the same configuration as the first upper down thrust blades 36 except having the leading edge 62 lower than the trailing edge 64 in the horizontal plane. The lower set of up thrust blades 34 as best shown in FIGS. 1 and 4, comprises a plurality of flat substantially rectangular lower up thrust blades each indicated as 66 and vertically disposed and coupled to the drive shaft 38 by collar 67.

To increase the vertical components of the liquid mass movement, an upper and lower directional control means is provided. As shown in FIGS. 1 and 2, the upper directional control means comprises a plurality of vertically disposed upper baffles each indicated as 68 extending inwardly from the upper portion 70 of the hollow enclosure or container 12. Alternating upper baffles **68*a* include a cut-out portion 72 on the inner end thereof while the other upper baffles 68 extend to the center of shaft 38. As shown in FIGS. 1 and 3, the lower directional control means comprises a plurality of vertically disposed lower baffles 74 on the lower portion of the container 12**.

The container 12 comprises a substantially cylindrical upper portion 70 having an intermediate portion including a first and second inclined surface 76 and 78 respectively, where the second inclined surface 78 is substantially parallel to the lower down thrust blades 54 and a lower substantially horizontal bottom 80. Disposed in communication with the discharge outlet 16 is a discharge chute 82 for selectively dispensing the colloidal mixture.

In operation, two dissimilar products are fed to the hollow enclosure 12 through the feed inlet 14. With the drive shaft 38 rotating through a conventional drive mechanism (not shown) the up thrust and down thrust generating components generate an upward and downward thrust as more fully described hereinafter. Specifically, as the two dissimilar products are directed inwardly toward the center of the apparatus 10 by baffles 68 the products are thrust downward under the mechanical force of the first upper down thrust blades 36 as shown by arrows a. The second upper down thrust blades 44 redirects the horizontal or rotational movement of the liquid mass 18 to the downward direction as shown by arrows b. As the liquid mass 18 travels downwardly as shown by arrows c with a substantial vertical component and a lesser horizontal component, the liquid mass 18 enters the lower down thrust blades 54 forcing the liquid mass 18 downwardly and outwardly toward the second inclined surface 78 as shown by arrows d. The liquid mass 18 is then redirected upwardly generating a substantially vertical component under the influence of the lower baffles 74.

The lower up thrust blades 66 force the liquid mass 20 to move outwardly and upwardly as shown by arrows e. As the liquid mass 20 moves upwardly the mechanical force of the upper up thrust blades 60 continues to force or propel the liquid mass 20 upwardly. The baffles 68 and reduce the centrifugal or horizontal component and direct the liquid mass 20 to enter into the mechanical influence of the first upper down thrust blade 36. This is continued until the desired colloidal mixture is produced.

As previously indicated alternating upper baffles **68*a* are reduced to permit proper and sufficient flow of the dissimilar products from the up thrust liquid mass 20 to its reintroduction to the down thrust liquid mass 18 under the influence of the first upper down thrust blades 36**.

When used with concrete mortar production, this provides higher mortar strengths, more economical cement use in concrete in general or practically producing much higher strengths in job concrete, greater application of pozzolanic additives, with the possibility of using siliceous by-products, such as fly ash, as a part or complete substitute for cement. This may involve inclusion of lime or less burnt cements in the mix.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described,

What is claimed is:

1. An apparatus for producing a colloidal mixture of a high degree of hydration comprising a hollow enclosure having a feed inlet to receive a product to be colloidalized and a discharge outlet to dispense the colloidal mixture comprising a thrust generating assembly including a down thrust generating component including a first upper set of down thrust blades comprising a plurality of substantially horizontal first upper down thrust blades in spaced relationship relative to each other to generate a downwardly directed vector and a second upper set of down thrust blades comprising a plurality of substantially vertical second upper down thrust blades in spaced relationship relative to each other, each said substantially vertical second upper down thrust blades attached to the outer portion of one of said plurality of substantially horizontal first upper down thrust blades to generate an inwardly directed vector such that said substantially horizontal first upper down thrust blades and said substantially vertical second upper down thrust blades cooperatively form a downwardly moving inner cylindrical liquid mass and a lower set of down thrust blades comprising a plurality of lower down thrust blades in spaced relationship relative to each other, the plane of each said lower down thrust blade being inclined relative to said plurality of substantially horizontal first upper down thrust blades to direct said downwardly moving inner cylindrical liquid mass outwardly and downwardly relative to said hollow enclosure; the upper portion of said lower down thrust blades being disposed substantially in the same vertical plane as the longitudinal center line of said plurality of substantially vertical second upper down thrust blades and an up thrust generating component including an upper set of up thrust blades comprising a plurality of substantially horizontal upper up thrust blades in spaced relationship relative to each other, each of said plurality of substantially horizontal upper up thrust blades being coupled to one of said substantially vertical second upper down thrust blades outwardly of said plurality of substantially horizontal first upper set of down thrust blades to generate an upwardly directed vector and a lower set of up thrust blades comprising a plurality of substantially vertical lower up thrust blades in spaced relationship relative to each other disposed adjacent to the lower portion of said lower set of down thrust blades to generate an outwardly and upwardly directed vector such that said substantially horizontal upper up thrust blades and said substantially vertical lower up thrust blades cooperatively form an upwardly moving outer cylindrical liquid mass disposed outwardly from said downwardly moving inner cylindrical liquid mass whereby said concentrically disposed cylinders of liquid mass move in opposite directions relative to each other within said hollow enclosure such that the interface between said moving liquid masses cooperatively form a liquid shear zone to impart a high energy shearing therebetween to produce a hydrated colloidal mixture.

2. The apparatus of claim 1 wherein each said first upper down thrust blade comprises a partial helical spiral configuration.

3. The apparatus of claim 1 wherein each said lower down thrust blade comprises a partial helical spiral configuration.

4. The apparatus of claim 1 wherein each is a plurality of substantially vertical second upper down thrust blades comprising an arcuate configuration.

5. The apparatus of claim 1 further including an upper directional control means comprising a plurality of vertically disposed upper baffles extending about the upper portion of said hollow enclosure to direct the vertical liquid mass upwardly.

6. The apparatus of claim 5 further including a lower directional control means comprising a plurality of vertically disposed lower baffles attached to the lower portion of said hollow enclosure.

7. A method for producing a colloidal mixture with a high degree of hydration, said method comprising the steps of:

a. supplying two dissimilar products to be colloidalized to a hollow enclosure, b. generating a down thrust vector and an inward thrust vector within the upper portion of said hollow enclosure forming a first cylindrical inner liquid mass forcing the two dissimilar products downwardly within said hollow enclosure, c. generating an angular downward thrust vector within the lower portion of said hollow enclosure to redirect said first liquid mass downwardly and outwardly with said hollow enclosure, d. generating an outward and upward thrust vector within the lower portion of said hollow enclosure forming a second cylindrical outer liquid mass forcing the two dissimilar products upwardly therein, e. generating an up thrust vector within the upper portion of said hollow enclosure to form a vertical shear zone between said first cylindrical liquid mass and said second cylindrical liquid mass to provide the colloidal mixing energy therebetween.

* * * * *